United States Patent [19]

Sholund

[11] Patent Number: 4,660,873

[45] Date of Patent: Apr. 28, 1987

[54] DOOR SECURING DEVICE

[76] Inventor: Richard J. Sholund, 12 First Ave., South Homecroft, Duluth, Minn. 55803

[21] Appl. No.: 778,174

[22] Filed: Sep. 19, 1985

Related U.S. Application Data

[63] Continuation of Ser. No. 505,700, Jun. 20, 1983, abandoned.

[51] Int. Cl.[4] ..... E05C 5/04

[52] U.S. Cl. ..... 292/251

[58] Field of Search ..... 292/251, DIG. 22, DIG. 60, 292/340; 411/347, 544; 49/67, 163

[56] References Cited

U.S. PATENT DOCUMENTS

| | | | |
|---|---|---|---|
| 104,474 | 6/1870 | Marshall | 292/251 X |
| 966,939 | 8/1910 | Mitchell | 292/251 X |
| 1,979,456 | 11/1934 | Dath | 292/340 X |
| 2,018,346 | 10/1935 | Busby | 292/251 X |
| 2,126,428 | 8/1938 | Tveden | 292/251 X |
| 2,478,972 | 8/1949 | Luce | 411/347 X |
| 2,967,557 | 1/1961 | Tait et al. | 292/251 X |
| 3,550,412 | 12/1970 | Pitel et al. | 292/251 X |
| 3,836,187 | 9/1974 | Buettner | 49/67 X |
| 3,847,422 | 11/1974 | Gulistan | 292/251 X |
| 3,984,137 | 10/1976 | Tinkle | 49/163 X |
| 4,190,272 | 2/1980 | Beard | 292/251 |

FOREIGN PATENT DOCUMENTS

| | | | |
|---|---|---|---|
| 607520 | 9/1948 | United Kingdom | 292/251 |

*Primary Examiner*—Robert L. Wolfe
*Assistant Examiner*—Lloyd A. Gall
*Attorney, Agent, or Firm*—Kinney & Lange

[57] ABSTRACT

A device which is installed as additional hardware and which allows two doors which are separated from each other in a common frame to be secured together and tightly against the doorjamb by engagement of parts mounted on the doors. A spindle with a handle on the interior side passes through the inner door to engage a fixture on the outer door and draw the doors together. A biasing spring and a keeper on the spindle in the space between the two doors are covered by a tamperproof housing which supports and allows axial movement of the spindle for engagement and disengagement with the fixture. The device is easy to engage and disengage by rotation of the handle. The spring clears the end of the spindle from the fixture by inwardly axial movement of the spindle when it is disengaged so that the pair of doors can be opened in the usual fashion with the usual hardware.

4 Claims, 2 Drawing Figures

DOOR SECURING DEVICE

This application is a continuation of co-pending application Ser. No. 06/505,700, filed June 20, 1983, for Door Securing Device, now being abandoned.

BACKGROUND OF THE INVENTION

This invention provides a means of securing two doors to each other in a way that provides greatly enhanced security for people in a dwelling in a simple, convenient and inexpensive manner. The invention is generally applicable to situations in which there is an outer door in the same frame with an inner door each with their separate hardware and locks.

In the ordinary situation the outer door may be a second door or it may be a screen or storm door. Generally the outer door is intended to protect the inner door from the weather and to provide an insulating and sound deadening effect. The outer door is generally equipped with its own doorknobs and lock, though in practice they are frequently of inferior and inadequate locking construction and are rarely used. Sometimes they have a latch type device rather than a standard key operated lock which serves to keep them from blowing open.

Generally the inside door is the main structural member for the dwelling, having its own doorknobs and lock and the inside door normally has a more expensive key operated lock for security. The inside doors are generally of better and thicker construction with better locks yet many of the locks are easily opened with a plastic card or a skeleton key. Even so, once the outer door is opened, the inner door is subject to being kicked in or broken into by a large man running his shoulder into it.

Many people have turned to installing additional locks on their inner door which are specially designed to resist opening with skeleton keys or plastic cards. Some have installed chains or bars of various types for greater security. Very heavy chains and bars are required to substantially enhance the impact resistance of a standard door so as to provide enough protection and the special locks tend to be expensive and require professional installation. Many of these devices are cumbersome and difficult to use because they tend to jam and stick. This is particularly true of the sliding bolt type security devices. In addition many of them are difficult to find and open under poor lighting conditions that might be typical of an emergency situation.

BRIEF SUMMARY OF THE INVENTION

Inner and outer doors are generally separated by a space of roughly 3 to 4½ inches between the facing surfaces. This leaves room for the doorknobs on each of the doors and permits the doors to be relatively flush with the respective inside and outside walls in which the door frame is installed.

A hole is drilled through the inside door at right angles to the door surfaces either above or below the existing doorknob and a threaded spindle is passed through the hole having an extended portion in the space between the two doors and a portion extending back into the dwelling space. An adjustable keeper is fastened to the spindle on the outside of the inner door and a spring is placed over the outwardly extending end of the spindle over which an extended housing will be placed with an opening in the end through which the spindle can protrude about ¼ inch which contains the spring between the housing and the adjustable keeper. A pair of holes are drilled through the door on either side of the spindle hole and round headed bolts on the exterior side are passed through the holes toward the inside to hold the housing in place. On the inside of the inner door a faceplate having a hole in the center is placed over the spindle and bolted to the inside door. The spindle openings in the housing and in the faceplate are larger than the size of the spindle to permit axial movement of the spindle.

A fixture having a threaded portion to engage the end of the spindle is located in line with the spindle and two holes are drilled through the outer door so that the fixture can be securely bolted to the outer door with the fixture mounted on the inside of the outer door with only the rounded heads of the bolts visible from the outside.

From the dwelling side an adjustable handle is placed on the spindle and adjusted so that the spindle can be pushed inwardly compressing the spring against the housing until the end of the spindle engages the fixture. Once good engagement of the fixture is obtained the bottom of the handle, which in construction will look like a doorknob, is adjusted to come into contact with the faceplate and the handle is locked in place on the spindle. Then continued rotation of the handle will draw the inner door and the outer door tightly against the doorjamb and secure them to each other so that they cannot be opened until the process is reversed sufficiently for the end of the spindle to become disengaged from the fixture at which point the spring will pop the spindle inwardly away from the fixture on the outer door to provide a clearance so that the outer door may be opened and closed normally.

Once this device is in place the only visible part on the outside of the dwelling are the heads of the two fastening bolts for the fixture. The lock is impossible to pick with a skeleton key or card and the device cannot be reached from the outside except by breaking through a window in the outer door, and even if this is done, the spindle is protected from unauthorized tampering by the housing which protects it.

Once the two doors are drawn up tight together, they form an impossible barrier to all outside intruders. Neither of the doors can rattle or open in the wind and the integrity of the dead air space between the doors is enhanced to prevent drafts and provide an energy saving feature. The adjustable feature of the device makes it possible to fit all new and existing doors by simple adjustment of the keeper and the handle. All that is required to install the device is a ½ inch drill bit, a ¼ inch drill bit and a screwdriver so that installation is simple. The lock is extremely strong yet easy to operate because it functions on the principal of a screw and uses a simple turning motion. The device uses inexpensive parts and is aesthetically pleasing as compared to chains and bars. It is simpler to use and easier to locate and operate by touch in a dark or smoke-filled room because of its similarity in operation and its proimity to the standard doorknob.

BRIEF DESCRIPTION OF THE DRAWINGS

There is 1 sheet of drawings containing the figures.

DETAILED DESCRIPTION AND SPECIFICATION

Figure 1:
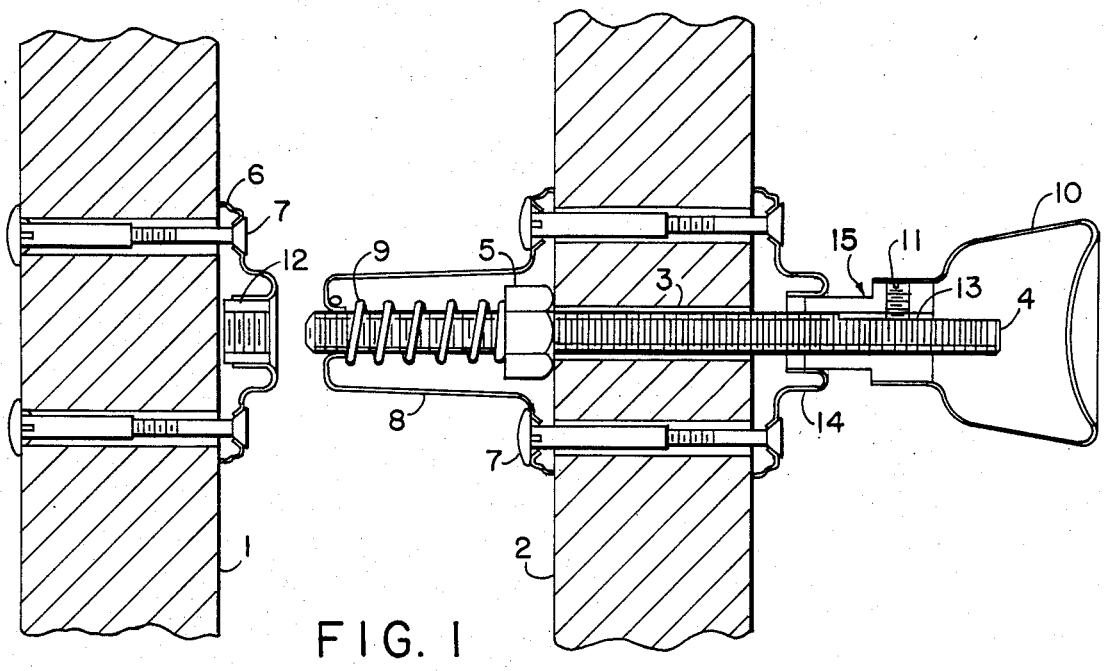
FIG. 1 is a cut-away side view of a pair of doors which have been equipped with the device.
Figure 2:
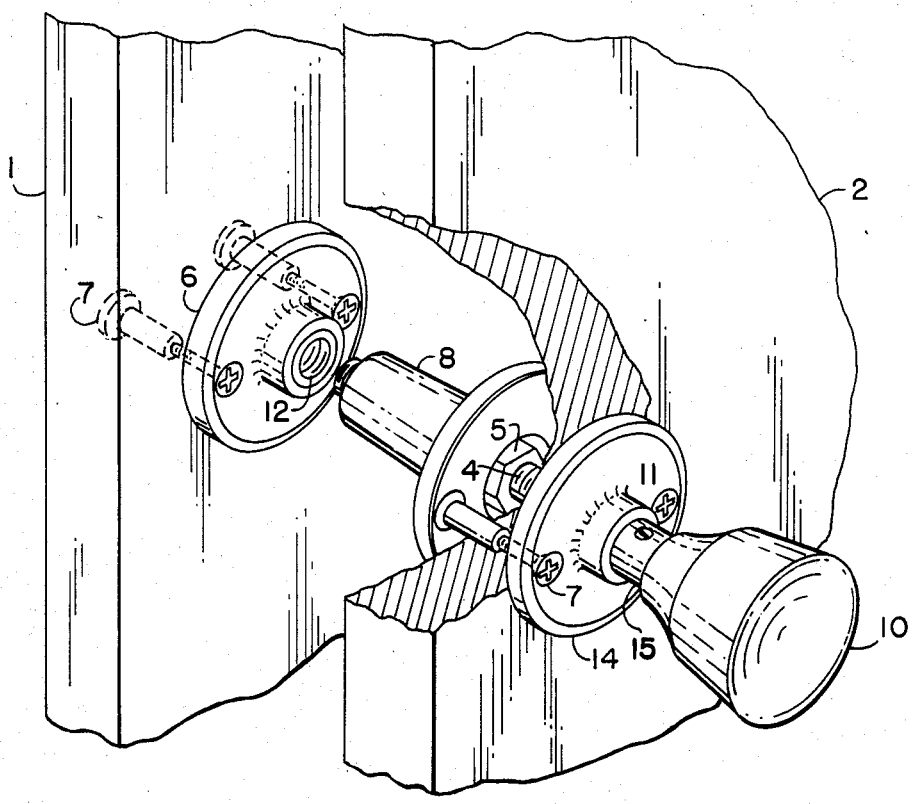
FIG. 2 is a perspective view of the assembled device of FIG. 1.

An outer door 1 is separated by a space from an inner door 2 as shown in FIG. 1. The outer door opens outwardly and the inner door opens inwardly with respect to a dwelling space inside. The space between the outer door 1 and the inner door 2 is the usual space provided for oppositely swinging doors in a common frame to provide room for the usual doorknobs (not shown) when each of the doors are in the closed position. The device of this invention is installed as additional hardware on the doors without replacing any of the existing latches, locks and knobs.

An opening 3 is bored at right angles through the inner door 2 and an imaginary line through the center of the bore 3 forms the axis or center line of the invention. A threaded spindle 4 slightly smaller in diameter than the bore of the opening 3 is inserted through the inner door outwardly toward the inside face of the outer door. The length of the spindle 4 is sufficient to reach the outer door while having a portion inwardly extending of sufficient length for an adjustable handle. The spindle is of generally uniform cross-section with a taper on the outwardly extending end for ease in starting the threads into a fixture which will be described later. A flat portion 13 of the inwardly extended end of the spindle 4 is shown in FIG. 1 for ease in fixing the handle at a desired location along the axis of the spindle. This is shown as a reduced cross-section which serves as a platform for a set screw in the handle. The handle is threaded onto the spindle a pre-set amount which limits the outward movement of the spindle along its axis.

A keeper 5 which is larger in diameter than the bore 3 performs a dual function. It is adjusted on the outwardly extending end of the spindle in the space between the two doors to establish the minimum outward extension of the spindle in that space because the keeper once placed on the spindle rests against the outside surface of the inner door and it is too large to pass through the bore 3. It also serves as a base for the end of a spring which biases the spindle inwardly.

A fixture 6 is mounted on the inside of the outer door with bolts 7 which pass through openings drilled in the outer door 1 so that the fixture is securely attached to the outer door 1 in line with the spindle axis. The fixture has an inwardly extending portion which is formed to define a threaded opening 12 mounted in line with the spindle into which the spindle can be securely threaded.

A housing 8 is mounted to the outside of the inner door by bolts 7. The housing 8 has an extended portion extending outwardly and the extended end of the housing 8 is formed to define an opening slightly larger than the cross-section of the spindle so as to slideably support the spindle and permit the spindle to move inwardly or outwardly along the spindle axis without binding. The extended end of the spindle is also formed to provide an internal surface to support the end of a spring 9.

The spring 9 has an inside diameter slightly larger than the cross-section of the spindle and is designed to slip over the spindle coaxially so that one end of the spring rests against the outward facing surface of the keeper 5 which supports that end of the spring and the other end of the spring rests against the inside of the extended portion of the housing so that the spring is disposed between the housing and the keeper around the spindle axis.

The length and stiffness of the spring is designed to provide a slight compressive force between the housing and the keeper so as to bias the spindle inwardly. The keeper is adjusted on the spindle so that there is clearance between the tapered outward extending end of the spindle and the spindle engaging fixture 6 when the pair of doors are closed. The end of the spindle is maintained in the opening at the extended end of the housing by the position of the keeper so that the spindle is slideably supported therein.

A faceplate 14 is installed on the inside of the inner door having a portion formed to define an opening slightly larger than a portion of a handle 10 located on the spindle which fits into the faceplate opening. The faceplate 14 is mounted in line with the spindle axis by bolts 7 so that the opening in the faceplate 14 slideably supports the handle for motion along the spindle axis without binding. The faceplate 14 is mounted to the surface of the door by bolts 7 on the opposite surface of the door from the housing 8 so it is convenient to use the same bolts 7 to secure both the faceplate and the housing to the inner door 2 as shown in FIG. 1. The area around the opening in the faceplate 14 is also formed to define a bearing surface for a shoulder 15 on the handle 10 to limit axial travel of the spindle in the outward direction by contact with the handle 10 and to resist tension force in the spindle which binds the doors to each other when the spindle is suitably engaged into the fixture.

The inwardly projecting portion of the spindle 4 is threaded and the handle 10 has an opening containing matching threads so that the handle can be threaded onto the spindle where it is attached in place with a set screw 11 resting against a flattened surface 13 of the inwardly extending spindle 4. The handle 10 is used for the purposes of supporting the spindle in the faceplate, moving the spindle axially, rotating the spindle and for limiting outward travel of the spindle along its axis by contact with the faceplate.

The handle 10 is adjusted so that hand pressure in the outward direction on the handle causes the outward end of the spindle to engage the fixture by outward pressure and rotation. Outward pressure on the handle compresses the spring to allow axial travel for this engagement. The shoulder of the handle should come into contact with the faceplate just after the outward end of the spindle is securely engaged into the fixture 6 so that continued rotation of the spindle into the fixture draws the two doors securely together against the doorjamb. This action mechanically attaches the two doors as a single unit tight against the doorjamb thus making it impossible to open either door while the easy opening door securing device is thus engaged.

When it is desired to open the door a person on the inside of the dwelling merely has to reverse the rotation of the handle which in turn rotates the outwardly extending end of the spindle out of the threads of the fixture until it becomes free, at which point the spring pops the spindle inwardly until the keeper rests against the outside of the inner door thus reestablishing the clearance between the spindle and the fixture. The outer door or the inner door can now be opened in the normal way.

In the best mode, the spindle is approximately 6 inches long and $\frac{3}{8}$ inch diameter with coarse threads for rapid threading. Threads should be present on both ends of the spindle and it is convenient to have the spindle entirely threaded and to have about a $1\frac{1}{2}$ inch flattened area on the handle end of the spindle for fixing the location of the handle. The fixture, housing and faceplate are satisfactorily manufactured from 24 guage brass which may be polished and lacquered for durability and attractive appearance. A brass insert 12 which is furnace brazed into a suitable opening in the fixture stamping is a convenient way to provide a strong, long-lasting, force-resistant fixture on the outer door. Solid-headed unslotted carriage bolts 7 are desirable for mounting the fixture as well as the parts on the inner door since they are strong and not subject to manipulation from the outside, thus they add to the security of the device. They are also adjustable for different thicknesses of door as shown in FIG. 1.

A self-locking mild steel nut of the appropriate size can be screwed onto the spindle to provide a simple and suitable keeper. A suitable spring has been made from 0.045 gauge spring music wire with an outside diameter of 0.600 inches having 7 turns per inch and a total uncompressed length of about 2¼ inches. The spring characteristics of a successful spring are such that a force of about 4.2 pounds will compress it one inch and a force or about 7.5 pounds will compress it fully.

Although the device can be located at different places on the pair of doors which are to be secured, the strongest installation is developed when the device is placed on the edges of the doors opposite from their hinges with doors that have hinges on the same side. Even so the device can be applied to doors where the outer door is oppositely hinged from the inner door although in that case it would be more desirable to have the device located near the center area of the doors. The vertical elevation of the device would normally be a short distance above or below the previously installed doorknobs so as to avoid interfering with the normal operation of the doors when the easy opening door securing device is not in use.

I claim:

1. In combination:

an outside auxiliary door for a building and an inside main door for a building, said doors being substantially parallel to each other and spaced apart a distance sufficient to accommodate normal door hardware, each door being hinged at one side to open and close independently, said outside auxiliary door opening outwardly and said inside main door opening inwardly, wherein said doors are located proximately to permit or prevent passage into a dwelling place or the like;

a rotatable slidable threaded spindle located at right angles to the faces of the doors, the spindle having a portion extending through the inside door and into the space between the doors;

a handle, means securing the handle to the inner end of the spindle inside of the inner door in such a manner that the handle can rotate the spindle;

means on the interior surface of the inside door for slidably supporting and centering the spindle in the opening in the inside door and restraining outward axial motion of the spindle by contact with a portion of the handle;

spring means surrounding the spindle outside of the inner door to bias said spindle inwardly;

a housing secured to the outer surface of the inner door between the two doors to cover the spring means on the spindle and prevent access to the spindle;

means within the housing to adjustably limit the inward travel of the spindle along the spindle axis; and spindle engaging means mounted in line with the spindle on the inside of the outside door and secured to the inner surface of the outer door by a plurality of threaded fastening means which extend through the door and which have unslotted heads on the outer ends thereof to make it difficult to remove the bolts from the outside, said spindle engaging means having a threaded female portion projecting inwardly towards the inner door from the inside of the outer door only substantially to the extent of the length of the threaded female portion and adapted to threadedly engage the threaded spindle, the spindle being effective upon said handle being pressed toward the inner door to extend said spindle outwardly into threaded engagement with the threaded portion of the spindle engaging means and upon rotation of the handle to move said spindle engaging means inwardly to draw said doors together tightly.

2. The combination of claim 1 in which there is an adjustable nut secured to the spindle and normally engaging the outer surface of the inner door to limit the inward movement of the spindle.

3. The combination of claim 1 in which the means on the inside door for slidably supporting the spindle is provided with a portion designed to engage the handle to limit outward axial motion of the spindle.

4. The combination of claim 1 in which the spindle normally projects only a small distance outwardly beyond the housing until the handle is pressed towards the inner door.

* * * * *